US005969467A

United States Patent [19]

Matsuno

[11] Patent Number: 5,969,467

[45] Date of Patent: Oct. 19, 1999

[54] FIELD EMISSION CATHODE AND CLEANING METHOD THEREFOR

[75] Inventor: Fumihiko Matsuno, Tokyo, Japan

[73] Assignee: NEC Corporation, Tokyo, Japan

[21] Appl. No.: 08/827,255

[22] Filed: Mar. 28, 1997

[30] Foreign Application Priority Data

Mar. 29, 1996 [JP] Japan ..... 8-076083

[51] Int. Cl.[6] ..... H01J 1/30; H01J 19/22

[52] U.S. Cl. ..... 313/309; 313/336; 313/495

[58] Field of Search ..... 313/306, 307, 313/308, 309, 310, 336, 351, 452, 495, 496, 497; 345/75; 315/169.3

[56] References Cited

U.S. PATENT DOCUMENTS

| | | | |
|---|---|---|---|
| 5,189,341 | 2/1993 | Itoh et al. | 315/169.1 |
| 5,404,025 | 4/1995 | Yamada | 257/10 |
| 5,559,390 | 9/1996 | Makishima et al. | 313/308 |
| 5,587,720 | 12/1996 | Fukuta et al. | 345/75 |
| 5,717,275 | 2/1998 | Takemura | 313/309 |
| 5,734,223 | 3/1998 | Makishima et al. | 313/495 |
| 5,786,659 | 7/1998 | Takagi et al. | 313/309 |

FOREIGN PATENT DOCUMENTS

| | | | |
|---|---|---|---|
| 0541394 | 5/1993 | European Pat. Off. | H01J 9/02 |
| 60-001741 | 1/1985 | Japan | H01J 37/073 |
| 4-022038 | 1/1992 | Japan | H01J 1/30 |
| 4022038 | 1/1992 | Japan | H01J 1/30 |
| 5-114353 | 5/1993 | Japan | H01J 9/02 |
| 5114353 | 5/1993 | Japan | H01J 9/02 |
| 5-198255 | 8/1993 | Japan | H01J 1/30 |
| 5198255 | 8/1993 | Japan | H01J 1/30 |
| 5266787 | 10/1993 | Japan | H01J 1/30 |
| 7182968 | 7/1995 | Japan | H01J 1/30 |

OTHER PUBLICATIONS

C. Spindt, "A Thin–Film Field–Emission Cathode", *Journal of Applied Physics,* vol. 39, No. 7, 1968, p. 3504 (Jun.).

W. Dawson Kesling et al., "Beam Focusing for Field–Emission Flat–Panel Displays", *IEEE Transactions on Electron Devices,* vol. 42, No. 2, Feb. 1995, pp. 340–347.

C.A. Spindt et al., "Physical properties of thin–film field emission cathodes with molybdenum cones", *Journal of Applied Physics,* vol. 47, No. 12, Dec. 1976, pp. 5248–5263.

*Primary Examiner*—Michael Day

*Attorney, Agent, or Firm*—Sughrue, Mion, Zinn, Macpeak & Seas, PLLC

[57] ABSTRACT

A field emission cathode includes a first electron-emitting structure having a first cathode electrode (3), a first gate electrode (5), a first insulating layer (4) separating the first cathode electrode (3) from the first gate electrode (5), and at least one first emitter tip (9) disposed in a hole formed in the first gate electrode (5) and the first insulating layer (4) to expose a portion of the first cathode electrode (3); and a second electron-emitting structure surrounding and insulated from the first electron-emitting structure wherein the second electron-emitting structure has a second cathode electrode (6), a second gate electrode (8), a second insulating layer (7) separating the second cathode electrode (6) from the second gate electrode (8), and at least one second emitter tip (10) disposed in a hole formed in the second gate electrode (8) and the second insulating layer (7) to expose a portion of the second cathode electrode (6).

16 Claims, 5 Drawing Sheets

FIELD EMISSION CATHODE AND CLEANING METHOD THEREFOR

BACKGROUND OF THE INVENTION

1. Field of the Invention

The present invention relates generally to field emission cathodes and methods of cleaning therefor.

2. Description of the Related Art

Electron sources or cathodes are essential to the functioning of all electron cathodes. Traditionally, cathodes for vacuum cathodes such as vacuum tubes and cathode ray tubes used thermionic emission to produce the required electrons. This required raising cathode materials to very high temperature conduction of current either by direct or through the use of auxiliary heaters. The process is very inefficient, requiring relatively large currents and dissipating most of the energy as wasted heat.

In recent years there has been a growing interest in replacing the inefficient thermionic cathodes with high field emission cathodes. These cathodes are very efficient because they eliminate the need to heat the cathode material. They have been used for a number of years as sources for scanning electron microscopes, and are now being investigated as sources for vacuum microelectronic cathodes, flat panel displays, and high performance high frequency vacuum tubes.

Field emission cathodes include very sharp points of field emission materials. These sharp points when biased with negative potential concentrate the electric field at the point. This high electric field allows the electrons to "tunnel" through the tip into surrounding space which is normally maintained under high vacuum conditions. The magnitude of the potential required to produce sufficiently strong electric fields is proportional to the distance between the tip and the principal extraction electrode. This principal extraction electrode will be referred to as the extraction electrode. While this extraction electrode can be a physically separate structure, minimum extraction potentials can most conveniently be obtained by physically integrating the extraction electrode directly with the field emission tips. This produces very small extraction electrode-cathode distances, which are physically locked in proper alignment. Field emission cathode structures both with and without integrated extraction electrodes are useful electron sources in a variety of current and potential applications such as displays, Vacuum Microelectronic Cathodes, and various electron microscopes.

The field emission display elements that utilize these cathodes use the basic field emission structure and add additional structures, such as, an extension of the vacuum space, a phosphor surface opposite the cathode tip, and additional electrodes to collect and/or control the electron current. Groups of individual Vacuum Microelectronics Cathodes and/or display elements are electrically interconnected during fabrication to form integrated circuits and/or displays.

While these field emission cathode structures can be made in almost any size and may have application as discrete sources, their best performance and major application is expected to come from extreme miniaturization, and dense arrays.

Non-thermionic field emitters, field emission cathodes, and field emission displays are all known in the art. The fabrication of the field emission cathode structure is a critical element common to the cathode mentioned. The material (insulators and conductors/field emitters) are all deposited and processed by relatively common deposition and lithographic processing techniques with the single exception of special sharp edge (blade) or point (tip) structure which is common to all field emission cathodes.

The art of fabricating the sharp field emission tip or blade can be classified into several categories.

In one of the earliest categories, the cathode tip structure is formed by the direct deposition of the material. An example of this type is described in a paper by C. A. Spindt, "A thin-Film Field-Emission Cathode", Journal of Applied Physics Vol. 39, No. 7, page 3504 (1968). In this paper, sharp molybdenum cone-shaped emitters are formed inside holes in a molybdenum anode layer and on a molybdenum cathode layer. The two layers are separated by an insulating layer that has been etched away in the areas of the holes in the anode layer down to the cathode layer. The cones are formed by simultaneous normal and steep angle depositions of the molybdenum and alumina, respectively, onto the rotating substrate containing the anode and cathode layers.

In this developing field, the art has produced closely packed arrays of such cones. One of the fabrications of arrays of cones is exemplified in a paper by C. A. Spindt, I. Brondie, L. Humphrey, and E. R. Westberg, 'Physical properties of thin-film field emission cathodes with molybdenum cones", Journal of Applied Physics, Vol. 47, No. 12, pages 5248 to 5263 (1976).

In this paper, field emission cathodes fabricated using thin-film techniques and microlithography are described, together with effects obtained by varying the fabrication parameters. The emission originates from the tip of molybdenum cones that are about 1.5 $\mu$m tall with a tip radius around 500 angstroms. Such cathodes have been produced in closely packed arrays containing 100 and 5000 cones as well as singly. Minimum currents in the range 50–150 $\mu$A per cone can be drawn with applied voltages in the range 100–300 V when operated in conventional vacuum at pressures $10^{-9}$ Torr or less. In the arrays, current densities (averaged over the array) of above 10 A/cm$^2$ have been demonstrated.

These field emission cathodes and extraction electrodes can be used in practical applications, such as flat-panel displays. In the display applications, beam focusing is required as is discussed in a paper by W. Dawson Kesling, and Charles E. Hunt entitled "Beam Focusing for Field-Emission Flat-Panel Displays", IEEE Transactions on Electron Cathodes, Vol. 42, No. 2, pages 340 to 347, February 1995. In the paper, two focused designs have been shown to yield exceedingly small beam widths. One design uses an aperture electrode parallel to the gate electrode on the cathode substrate for beam focusing. The other is a concentric electrode design, in which the focus electrode lies in the same plane as the gate electrode and surrounds each emission tip.

In the practical applications, it is necessary to avoid disruption of the cathode in life. This disruption is caused by a local gas discharge forming between the tips and the gate electrode. Gas out of the active components of the cathode, including the cathode itself, is the main source of gas for this discharge. It is known that bombarding all the active parts of the cathode (including the cathode) with electrons can eliminate this effect. The several bombarding techniques have been described in JP-A 4-22038, JP-A 5-198255, and JP-A 114353.

JP-A 4-220388, which apparently corresponds to U.S. Pat. No. 5,189,341, describes electron-bombarding technique. A plurality of pairs of cathodes separated from each other is used. A portion of electrons from emitter tips on one cathode of each pair is drawn toward emitter tips on the other cathode for electron bombardment when the emitter tips on the other cathode do not emit electrons. A portion of electrons from the emitter tips on the other cathode is used for bombardment of the emitter tips on the one cathode.

JP-A 5-198255, which appears to correspond to EP-A 0 541 394, describes an electron-bombarding technique in which an anode electrode is used to direct substantially all of electrons from emitter tips on one cathode to emitter tips on the adjacent cathode.

JP-A 5-114353 shows, a plurality of emitter tips surrounding an emitter tip on a cathode. The surrounding emitter tips emit electrons for bombardment of the emitter tip surrounded thereby. The surrounding emitter tips are formed on an extraction electrode of the surrounded emitter tip. Thus, the extraction electrode is negatively biased for urging the surrounding emitter tips to emit electrons and the cathode of the surrounded emitter is positively biased to draw the electrons. According to this arrangement, positive voltage applied to the cathode cannot be increased to a sufficiently high level because the extraction electrode is negatively biased. This is because the difference in potential between the surrounded emitter tip and the extraction electrode must be low enough not to induce electrical discharge across a gap between them.

JP-A 60-1741 describes an electron gun in which a filament is opposed to an anode to heat the surface of the anode during a gas discharge process thereby facilitating gas discharge from the anode. In operation of the cathode, the filament is positively biased thus preventing ions separated from the surface of the anode from leaving therefrom.

An object of the present invention is to provide a field emission cathode that makes it possible and easy to clean not only emitter tips but also electrodes by electron-bombarding during discharge process before sealing a space around the emitter tips and electrode.

A specific object of the present invention is to provide a field emission cathode that allows beam focusing to yield small electron beam widths after electron-bombarding of electrodes as well as emitter tips during discharge process.

Another object of the present invention is to provide a method of cleaning a field emission cathode during gas discharge process before sealing a space around emitter tips and electrodes.

SUMMARY OF THE INVENTION

The present invention employs electron bombarding to clean or remove contaminants from emitter tips and electrodes.

According to the present invention, a first field emission structure is surrounded by a second field emission structure wherein gate electrode of the first field emission structure and cathode electrode of the second field emission structure are separated by insulator.

The second emission structure is biased with negative potential and the gate and cathode electrodes of the first emission structure are biased with the same positive voltage. This allows electrons to bombard the first emission structure at the gate electrode and emitter tip.

When the cathode electrode of the first emission structure is biased with a positive voltage higher than the positive voltage with which the gate electrode of the first emission structure is biased, substantially all of electrons are drawn by emitter tip of the first emission structure.

When an anode electrode extends over the first and second emission structures, the anode is biased with negative voltage thereby urging the electrons toward the first emission structure.

When an anode electrode extends over the first and second emission structures, the anode is biased with positive voltage, the gate and cathode electrodes of the first emission structure are biased with the same negative voltage, and the second emission structure is biased with negative potential. This allows substantially all of electrons from the second emission structure to bombard the anode.

In operation of the cathode, the first emission structure is biased with negative potential and the gate and cathode electrode of the second emission structure are biased with the same negative voltage for beam focusing.

According to one aspect of the present invention, there is provided a field emission cathode comprising:

a first electron-emitting structure including a first cathode electrode and a first gate electrode, which are separated by a first insulator layer, and at least one first emitter tip in a hole formed through said first gate electrode and said first insulator layer to expose a portion of said first cathode electrode; and a second electron-emitting structure surrounding said first electron-emitting structure, said second electron-emitting structure being insulated from said first electron-emitting structure.

DESCRIPTION OF THE PREFERRED EMBODIMENTS

Figure 1:
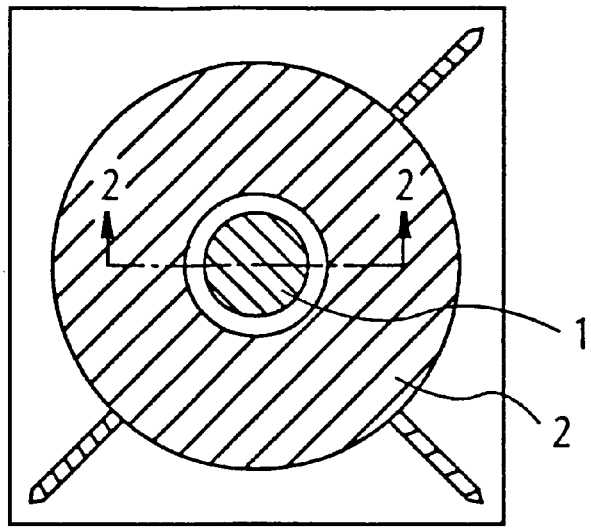
FIG. 1 is a schematic plan view of a first embodiment of a field emission cathode according to the present invention illustrating two distinct electron emission structures, namely a first electron emission structure and a second electron emission structure surrounding the first emission structure.
Figure 2:
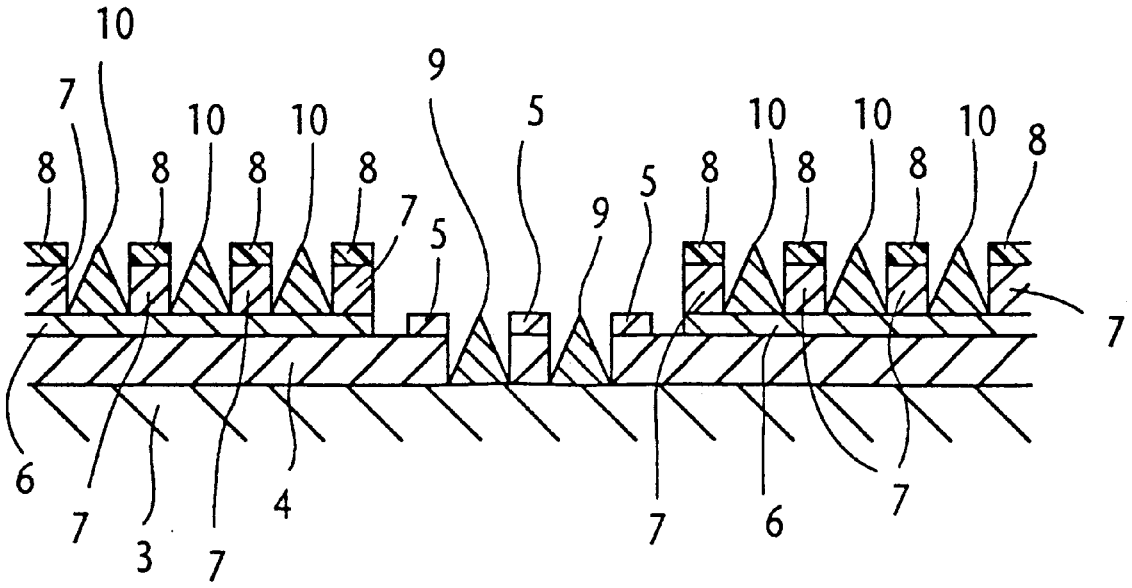
FIG. 2 is a cross sectional view, magnified in scale, taken along the line 2—2 in FIG. 1.

Referring to the accompanying drawings, the present invention is described in detail. FIGS. 1 and 2 are views showing structure of a first embodiment of a field emission cathode according to the present invention. FIG. 1 is a schematic plan view of a chip. Within the same chip, there are two electron emission structures, namely, a first electron emission region 1 and a second electron emission region 2. The first emission structure 1 includes a first cathode electrode layer 3, a first insulating layer 4 and a first gate electrode 5 that is separated from the first cathode electrode layer 3 by the first insulating layer 4. The first emission structure 1 includes at least one or a plurality of first emitter tips 9 on the first cathode electrode layer 3 (silicone substrate). Each of the emitter tips 9 is disposed in a hole or cavity formed through the first gate electrode 5 and the first insulating layer 4 to expose a portion of the first cathode electrode layer 3. Viewing in FIG. 1, the first emission structure 1 is bounded by the circular outer periphery of the first gate electrode 5 and it is surrounded by the second emission structure 2. The second emission structure 2 includes a second cathode electrode 6 formed on the first insulating layer 4. The second cathode electrode 6 is formed on the first insulating layer 4 and it is separated from the first gate electrode 5 and thus insulated therefrom. The second emission structure 2 includes a second insulating layer 7 and a second gate electrode 8 that is separated from the second cathode electrode 6 by the second insulating layer 7. The second emission structure 2 includes at least one or a plurality of second emitter tips 10 on the second cathode electrode 6. Each of the second emitter tips 10 is disposed in a hole or cavity that is formed through the second gate electrode 8 and the second insulating layer 7 to expose a portion of the second cathode electrode 6.

Figure 3A:
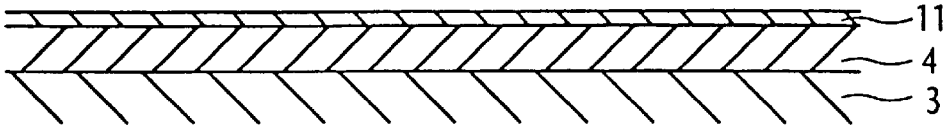
FIGS. 3A through 3E are cross sectional views taken along the line 2—2 in FIG. 1 for successive steps in the method of fabrication of the cathode of FIG. 1.

FIGS. 3A through 3E demonstrate the fabrication of the first embodiment of field emission structure. In FIG. 3A, starting with a substrate, which can be of any conductive material, such as silicon Si, to make the first cathode electrode 3, a first insulator layer, which can be of any insulative material, such as silicon dioxide $SiO_2$, to make the first insulator layer 4, is deposited on the substrate 3. Then, a metal layer 11, which can be of any suitable metal, such tungsten, is deposited on the first insulator layer 4. In this example, the first insulator layer 4 is of approximately 0.8 $\mu$m in thickness, and the metal layer is of approximately 0.2 $\mu$m in thickness.

Figure 3B:
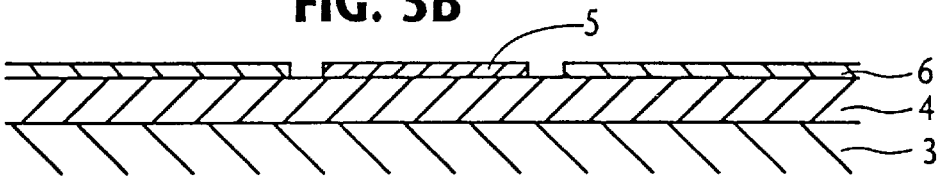

As shown in FIG. 3B, unnecessary portions of the metal layer 11 are removed by photolithography and etching to define the first gate electrode 5 of the first emitting structure and the second cathode electrode 6 of the second emitting structure. The second cathode electrode 6 is insulated from the first gate electrode 5.

Figure 3C:
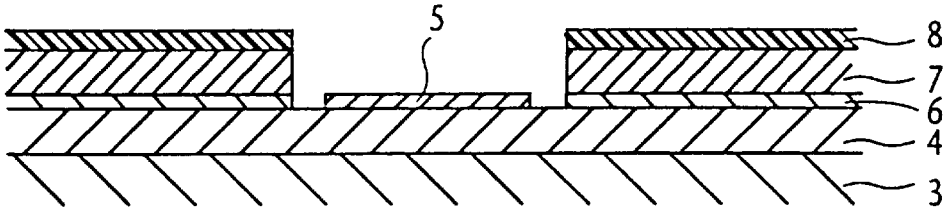

As shown in FIG. 3C, a second insulator layer, which can be of any insulative material such as silicon dioxide to make the second insulator layer 7, is deposited in a coextensive manner on the second cathode electrode 6. A conductive layer, which can be of any conductive material such as tungsten to make the second gate electrode 8, is deposed in a coextensive manner on the second insulator layer 7.

Figure 3D:
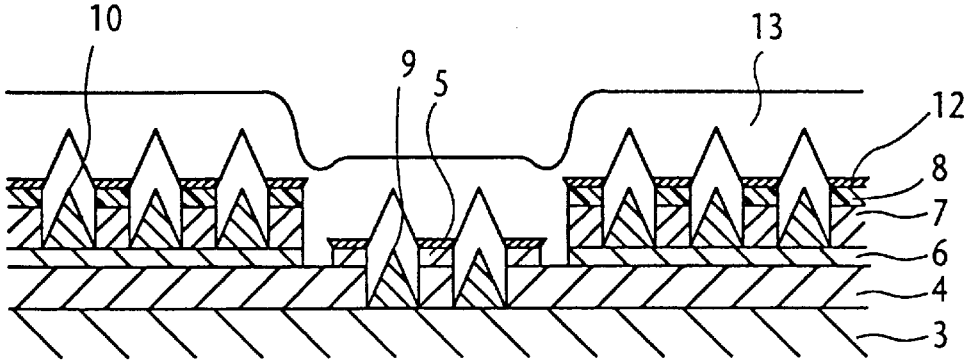

As shown in FIG. 3D, a plurality of small holes or cavities are formed through the first gate electrode 5 and the first insulator layer 4 to expose the first cathode electrode 3 by photolithography and etching. Similarly, a plurality of small holes or cavities are formed through the second gate electrode 8 and the second insulator layer 7 to expose the second cathode electrode 6. Each of the small holes is of approximately 1 $\mu$m in diameter. After forming the small holes, simultaneous steep angle deposition of a parting material 12 such as aluminum Al and normal deposition of an electron-emitting material 13 such as molybdenum Mo are conducted using evaporation technique thereby forming first emitter tips 9 and second emitter tips 10.

Figure 3E:
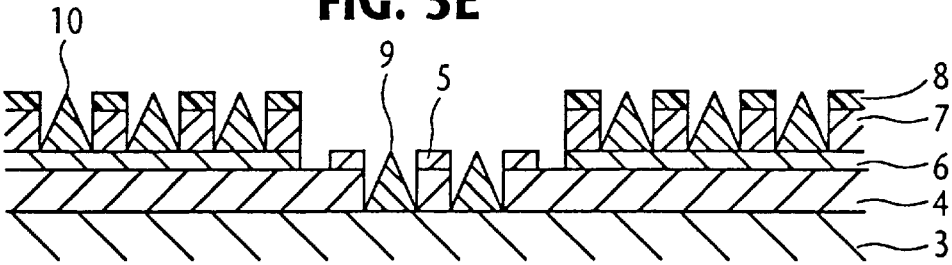

Finally the parting material 12 and unnecessary portion of the electron-emitting material 13 are chemically removed by phosphoric acid thereby providing the structure as shown in FIG. 3E. This structure is ready for mounting in a vacuum tube.

Figure 4:
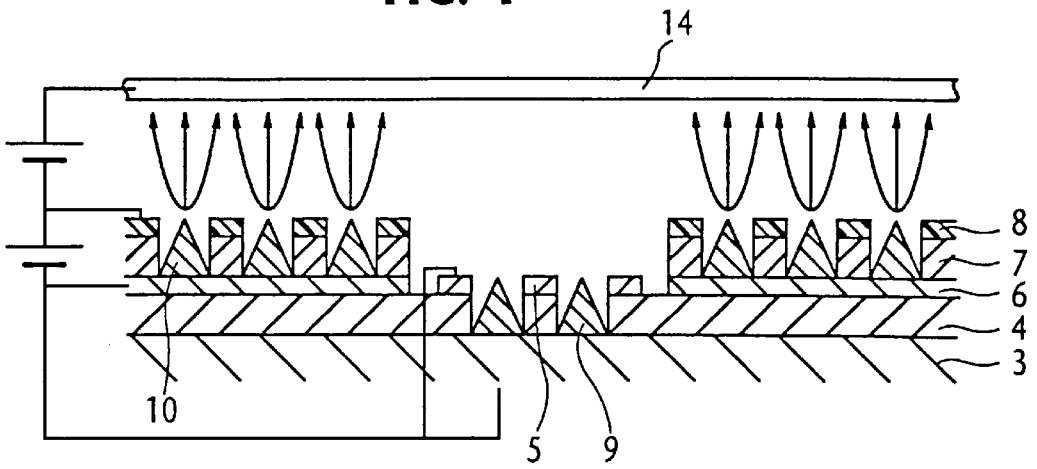
FIGS. 4 through 6 are cross sectional views taken along the line 2—2 in FIG. 1 for steps in the method of cleaning the cathode of FIG. 1.
Figure 5:
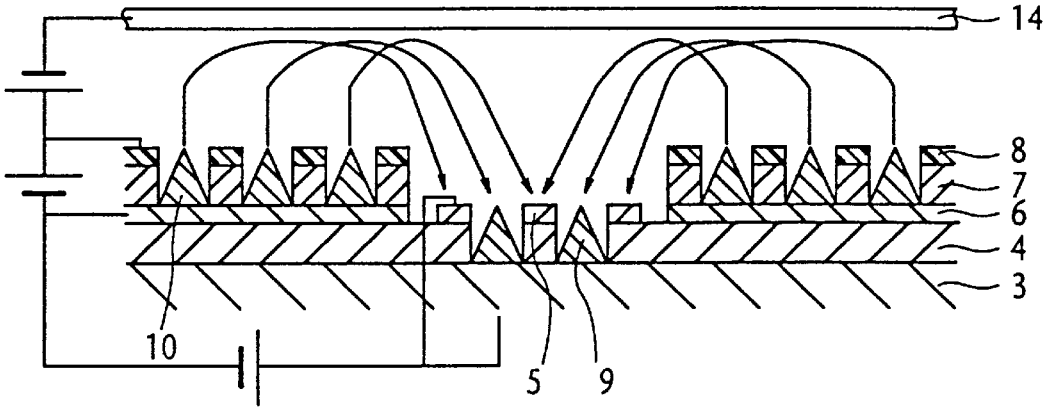
Figure 6:
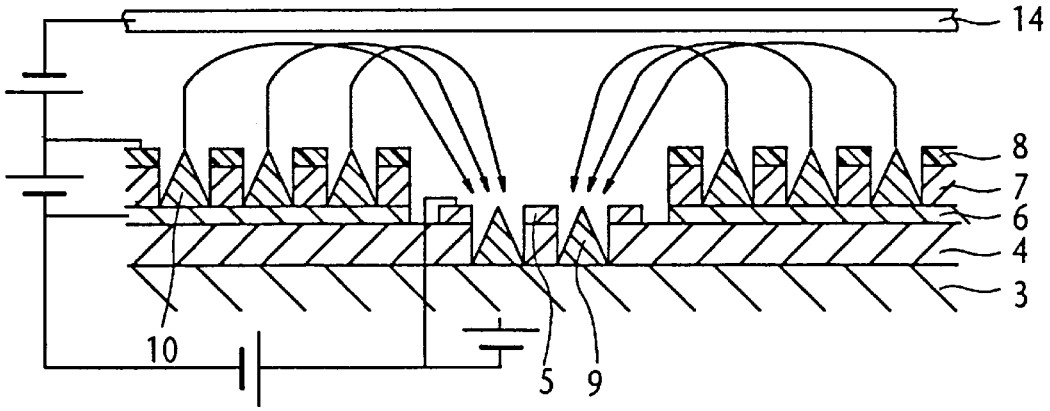

Referring to FIGS. 4, 5, and 6, the cleaning method is described. In the gas discharge process, a voltage is applied between the second gate electrode 8 and the cathode electrode 6 so that the gate electrode 8 is biased with positive voltage. This allows electric field to concentrate about the tips of the second emitter tips 10 thereby freeing electrons into the surrounding space. When an anode electrode 14 is to be cleaned, with the first gate electrode 5 and the first cathode electrode 3 short circuited, the anode electrode 14 is biased with higher positive voltage than the second gate electrode 8 is biased with, as shown in FIG. 4. Electrons out of the second emitter tips 10 bombard the anode electrode 14 to clean the anode electrode 14. Preferably, electron beams above a predetermined level should be accelerated with voltage higher than an operation voltage for bombarding the anode electrode 14. Thus, the number of the second emitter tips 10 of the second electron-emitting structure 2 should be several to several tens times as much as the number of the first emitter tips 9 of the first electron-emitting structure 1.

Referring to FIG. 5, let us now explain how to clean the first emitter tips 9 of the first electron-emitting structure 1. The short-circuited first gate and cathode electrodes 5 and 3 are biased with positive voltage that is higher than the voltage with which the second gate electrode 8 is biased. Electrons freed out of the second emitter tips 10 are urged toward the first gate electrode 5 and the first emitter tips 9 for bombardment due to repulsion from the anode electrode 14. If it is required to concentrate electron beam on the first emitter tips, the first cathode electrode 3 should be biased with higher positive voltage as shown in FIG. 6.

After the gas discharge process, the surrounding space is sealed. Thus, each of the electrodes and each of the first emitter tips are maintained free from contaminants.

Figure 7:
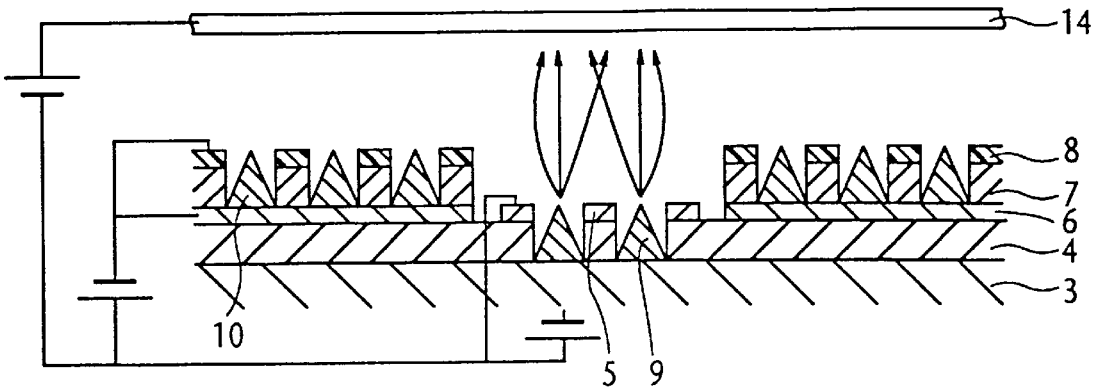
FIG. 7 is a cross sectional view taken along the line 2—2 in FIG. 1 for operation of the cathode of FIG. 1.

As shown in FIG. 7, when the device is in operation, the first electron-emitting structure 1 is biased to free electrons out of the first emitter tips 9 with the second gate and cathode electrodes 8 and 6 short-circuited. In this case, the electrodes of the second electron-emitting structure 2 are biased with negative potential lower than a potential with which the first gate electrode 5 is biased. In this case, the electrodes of the second electron-emitting structure serve as a focus electrode for electron beam.

Figure 8:
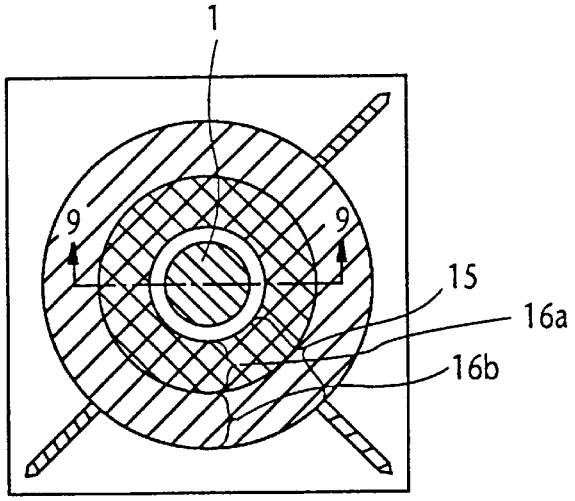
FIG. 8 is similar view to FIG. 1 showing the second embodiment.
Figure 9:
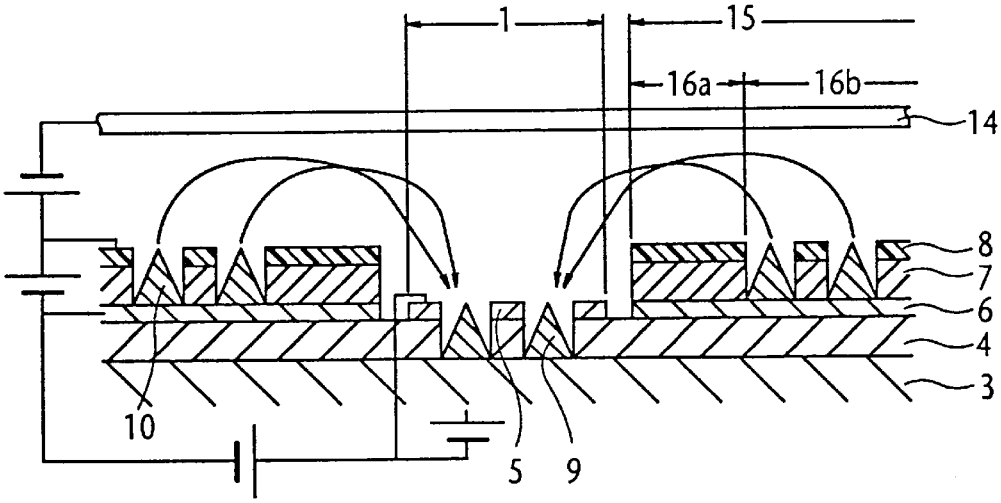
FIG. 9 is a cross sectional view, magnified in scale, taken along the line 9—9 in FIG. 8, illustrating a similar view to FIG. 6 for the step of cleaning the cathode of FIG. 8.

FIGS. 8 and 9 illustrates the second embodiment of field emission cathode and its cleaning process, respectively. The same reference numerals as used in the first embodiment are used to designate the same or similar parts or portions as and to those of the first embodiment. This second embodiment is substantially the same as the first embodiment except that a second electron-emitting structure 15 is divided into two concentric regions, namely, an inner circular region 16*a* and an outer circular region 16*b*. The inner circular region 16*a* surrounds a first electron-emitting structure 1 and the outer circular region 16*b* surrounds the inner circular region. Within the inner circular region 16*a*, the second gate electrode 8 is continuous and no emitter tips are arranged. Within the outer circular region 16*b*, all of the emitter tips 10 required for the second electron-emitting structure 15 are arranged.

As is readily seen from FIG. 9, electrons freed out of the second emitter tips 10 are drawn by the positive potential of the second gate electrode 8 within the inner circular region 16*a* in addition to repulsion induced by the negative potential of anode electrode 14. The second electron-emitting structure 15 of this embodiment contributes much to concentration of electrons around the first emitter tips 9.

Figure 10:
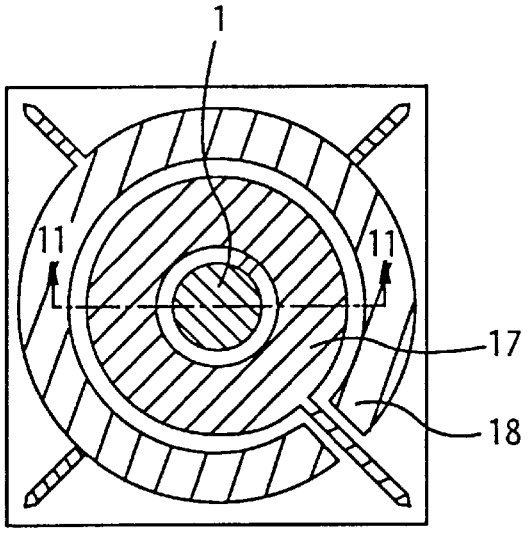
FIG. 10 is a similar view to FIG. 1 showing the third embodiment.
Figure 11:
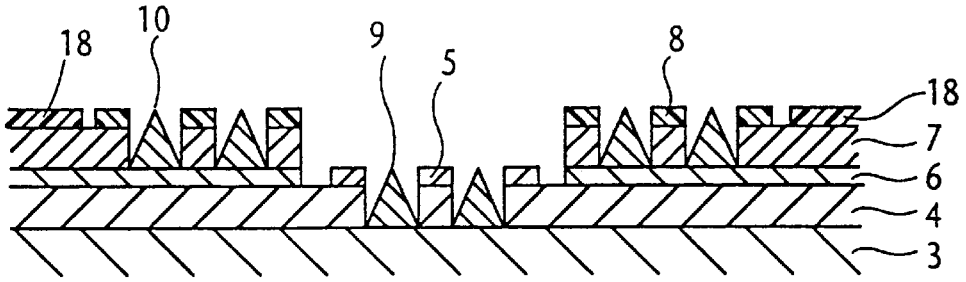
FIG. 11 is a cross-section, magnified in scale, taken along the line 11—11 in FIG. 10.
Figure 12:
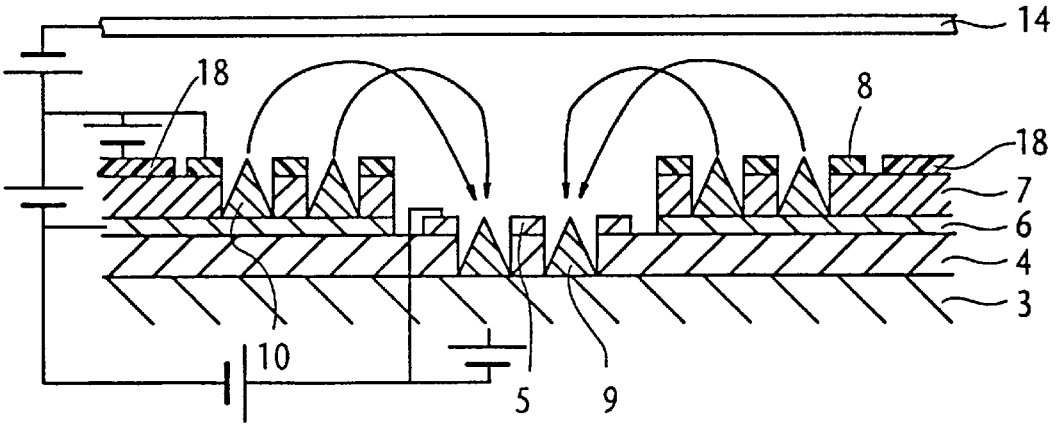
FIG. 12 is a similar view to FIG. 6 for the step of cleaning the cathode of FIG. 10.

Referring to FIGS. 10 through 12, the third embodiment is described. This third embodiment is substantially the same as the first embodiment except the provision of an outer concentric focus electrode 18. This focus electrode 18 surrounds a second electron-emitting structure 17.

When an anode electrode 14 is to be cleaned, the focus electrode 18 is not biased with any voltage.

Referring to FIG. 12, the process of cleaning the first emitter tips 9 is explained. This process is substantially the same as the process described in connection with FIG. 6. Thus, all of the electrodes except the focus electrode 18 are biased in the same manner as their counterpart shown in FIG. 6 are biased. The focus electrode 18 is biased with negative potential lower than the potential with which the second gate electrode 8 is biased. Electrons freed out of the second emitter tips 10 are biased inward toward the first emitter tips 9 due to interaction with electric field around the focus electrode 18. This arrangement including the focus electrode 18 therefore contributes much to concentration of electrons for bombardment of the first emitter tips 9.

In operation of the device, all of the electrodes except the focus electrode 18 are biased in the same manner as their counterparts are biased in FIG. 7. Second gate electrode 8 and second cathode electrode 6 are short-circuited and serve as a focus electrode. The newly added focus electrode 18 should be biased with negative potential as low as or lower than the potential with which the short-circuited electrodes 8 and 6 are biased. With the focus electrode 18, electron beams with smaller width can be obtained.

What is claimed is:

1. A field emission cathode comprising:

a first electron-emitting structure including a first cathode electrode and a first gate electrode, which are separated by a first insulator layer, and at least on first emitter tip in a hole formed through said first gate electrode and said first insulator layer to expose a portion of said first cathode electrode; and a second electron-emitting structure surrounding said first electron-emitting structure, said second electron-emitting structure being insulated from said first electron-emitting structure;

wherein said second electron-emitting structure includes a second cathode electrode and a second gate electrode, which are separated by a second insulator layer, and at least one second emitter tip in a hole formed through said second gate electrode and said second insulator layer to expose a portion of said second cathode electrode.

2. A field emission cathode as claimed in claim 1, wherein said first gate electrode is deposited on said first insulator layer, and wherein said second cathode electrode is deposited on said first insulator layer and separated from said first gate electrode.

3. A field emission cathode as claimed in claim 2, wherein said second electron-emitting structure is disposed outward of said first electron-emitting structure and disposed above a level in which said first insulator layer is disposed.

4. A field emission cathode as claimed in claim 2, wherein said second cathode electrode surrounds said first gate electrode.

5. A field emission cathode as claimed in claim 2, wherein said second insulator layer is deposited on said second cathode electrode, and said second gate electrode is deposited on said second insulator layer.

6. A field emission cathode as claimed in claim 5, wherein said second insulator layer and said second cathode electrode are coextensive.

7. A field emission cathode as claimed in claim 6, wherein said second gate electrode and said second insulator layer are coextensive.

8. A field emission cathode as claimed in claim 5, wherein said first insulator layer is deposited on said first cathode electrode.

9. A field emission cathode as claimed in claim 8, wherein said second electron-emitting structure includes and divided into an inner region around said first electron-emitting structure and an outer region.

10. A field emission cathode as claimed in claim 9, wherein said at least one second emitter tips is disposed in said outer region.

11. A field emission cathode as claimed in claim 10, wherein said second gate electrode extends continuously within said inner region.

12. A field emission cathode as claimed in claim 1, further comprising:

a focus electrode surrounding said second electron-emitting structure.

13. A field emission cathode as claimed in claim 1, wherein said second cathode electrode and said second gate electrode are short-circuited thereby serving as a focus electrode.

14. A method of cleaning a field emission cathode including a first electron-emitting structure having a first insulator layer, a first cathode electrode, a first gate electrode that is separated from said first cathode layer by said first insulator layer, and at least one first emitter tip in a hole formed through said first gate electrode and said first insulator layer to expose a portion of said first cathode electrode, and a second electron-emitting structure surrounding said first electron-emitting structure and insulated therefrom, wherein said second electron-emitting structure includes a second cathode electrode and a second gate electrode, which are separated by a second insulator layer, and at least one second emitted tip in a hole formed through said second gate electrode and said second insulator layer to expose a portion of said second cathode electrode, said method comprising the steps of:

biasing said second electron-emitting structure with negative potential to induce emission of electrons; and biasing said first gate electrode and said at least one first emitter tip with a voltage higher than a gate voltage applied to said second electron-emitting structure thereby urging the electrons toward said first gate electrode and said first emitter tip for bombarding same.

15. A method as claimed in claim 14, further comprising the step of:

biasing an anode electrode that extends over said first and second electron-emitting structures with a voltage that is lower than said gate voltage applied to said second gate electrode thereby urging the electrons toward said first electron-emitting structure.

16. A method of cleaning a field emission cathode including a first electron-emitting structure having a first insulator layer, a first cathode electrode, a first gate electrode that is separated from said first cathode layer by said first insulator layer, and at least one first emitter tip in a hole formed through said first gate electrode and said first insulator layer to expose a portion of said first cathode electrode, a second electron-emitting structure surrounding said first electron-emitting structure and insulated therefrom, wherein said second electron-emitting structure includes a second cathode electrode and a second gate electrode, which are separated by a second insulator layer, and at least one second emitter tip in a hole formed through said second date electrode and said second insulator layer to expose a portion of said second cathode electrode, and an anode electrode extending over said first and second electron-emitting structures, said method comprising the steps of:

biasing said second electron-emitting structure with negative potential to induce emission of electrons;

biasing said anode electrode with a voltage that is higher than a gate voltage applied to said second electron-emitting structure thereby urging the electrons toward said anode electrode for bombarding said anode electrode;

biasing said anode electrode with a voltage that is lower than said gate voltage applied to said second electron-emitting structure; and biasing, with said anode electrode biased with said voltage lower than said gate voltage, said first gate electrode and said at least one first emitter tip with a voltage that is higher than said gate voltage thereby urging the electrons toward said first gate electrode and said at least one first emitter tip for bombarding same.

* * * * *